US010737821B2

(12) United States Patent
Thuring et al.

(10) Patent No.: US 10,737,821 B2
(45) Date of Patent: Aug. 11, 2020

(54) DEVICE FOR PRINTING, SEVERING AND APPLYING SELF-ADHESIVE FLAT STRUCTURES, IN PARTICULAR LABELS

(71) Applicant: LOGOPAK SYSTEME GMBH & CO. KG, Hartenholm (DE)

(72) Inventors: Lars Thuring, Bad Bramstedt (DE); Carsten Schweder, Weddelbrook (DE); Alexander Hamer, Köln (DE)

(73) Assignee: LOGOPAK SYSTEME GmbH & CO. KG, Hartenholm (DE)

( * ) Notice: Subject to any disclaimer, the term of this patent is extended or adjusted under 35 U.S.C. 154(b) by 0 days.

(21) Appl. No.: 16/096,908

(22) PCT Filed: Apr. 26, 2017

(86) PCT No.: PCT/EP2017/059994

§ 371 (c)(1),
(2) Date: Oct. 26, 2018

(87) PCT Pub. No.: WO2017/186821

PCT Pub. Date: Nov. 2, 2017

(65) Prior Publication Data

US 2019/0118988 A1 Apr. 25, 2019

(30) Foreign Application Priority Data

Apr. 28, 2016 (DE) ..... 20 2016 102 279 U

(51) Int. Cl.
*B65C 9/25* (2006.01)
*B65C 9/18* (2006.01)
(Continued)

(52) U.S. Cl.
CPC ..... *B65C 9/25* (2013.01); *B65C 9/1826* (2013.01); *B65C 9/28* (2013.01); *B65C 9/36* (2013.01); *G09F 3/02* (2013.01)

(58) Field of Classification Search
CPC ..... B65C 9/25; B65C 9/1826; B65C 9/36; Y10T 156/12; Y10T 156/1322
See application file for complete search history.

(56) References Cited

U.S. PATENT DOCUMENTS 2,492,908 A 12/1949 Von Hofe
RE24,097 E 11/1955 Von Hofe
(Continued)

FOREIGN PATENT DOCUMENTS

DE 9304848 U1 6/1993
DE 102004004827 A1 9/2005
(Continued)

OTHER PUBLICATIONS

International Search Report dated Jul. 10, 2017 in related International Application No. PCT/EP2017/059994.
(Continued)

*Primary Examiner* — Mark A Osele
*Assistant Examiner* — Christopher C Caillouet
(74) *Attorney, Agent, or Firm* — Patent Portfolio Builders PLLC

(57) ABSTRACT

A device for printing, severing and applying self-adhesive labels, wherein the device operates with a label material without a carrier strip. The label material has a printable layer, a carrier layer and a heat-sealable adhesive layer. The device has an applicator, by way of which the label is applied to an object to be labelled. The applicator can be moved up to the object to be labelled by way of a handling device, and the handling device is constructed in accordance with the principle of an open kinematic chain and has at least one translational kinematic axis and/or at least one rotational kinematic axis. The applicator can be heated by way of a heating device which operates in accordance with an electrical operating principle.

11 Claims, 9 Drawing Sheets

Figure 1:
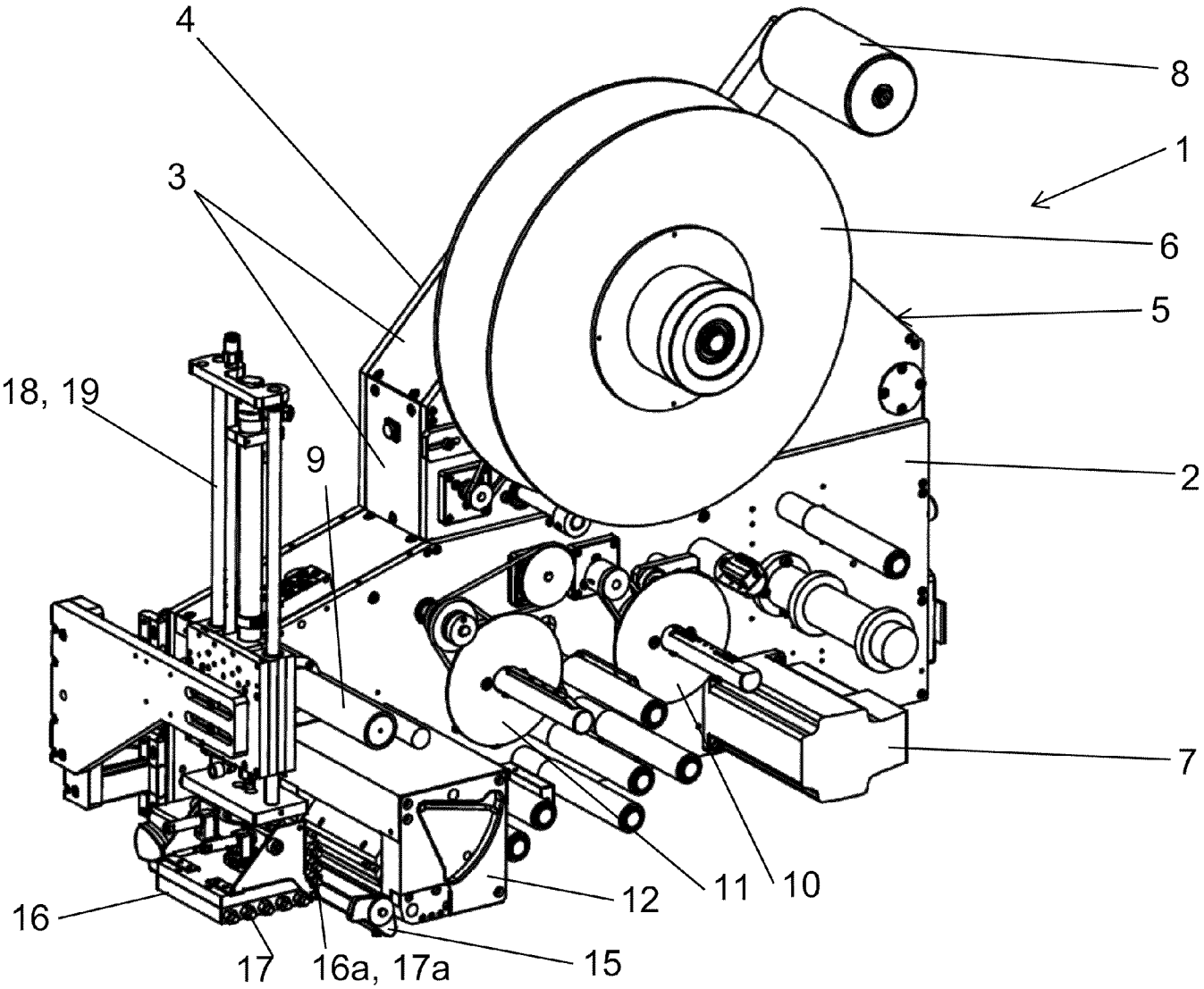

(51) Int. Cl.

| | |
|---|---|
| ***B65C 9/36*** | (2006.01) |
| ***B65C 9/28*** | (2006.01) |
| ***G09F 3/02*** | (2006.01) |

(56) References Cited

U.S. PATENT DOCUMENTS

| | | | | |
|---|---|---|---|---|
| 4,340,187 | A * | 7/1982 | Schippers | B65H 63/006 242/473.7 |
| 4,390,390 | A | 6/1983 | Margraf et al. | |
| 4,707,211 | A | 11/1987 | Shibata | |
| 5,674,345 | A * | 10/1997 | Nash | B65C 9/1803 156/264 |
| 2010/0006232 | A1 | 1/2010 | Dangami | |
| 2013/0079917 | A1 * | 3/2013 | Deppermann | B07C 5/3425 700/218 |

FOREIGN PATENT DOCUMENTS

| | | | |
|---|---|---|---|
| DE | 202013103136 | U1 | 8/2013 |
| EP | 1879751 | B1 | 12/2011 |
| WO | 03086873 | A1 | 10/2003 |

OTHER PUBLICATIONS

Written Opinion dated Jul. 10, 2017 in related International Application No. PCT/EP2017/059994.

* cited by examiner

DEVICE FOR PRINTING, SEVERING AND APPLYING SELF-ADHESIVE FLAT STRUCTURES, IN PARTICULAR LABELS

BACKGROUND AND SUMMARY OF THE INVENTION

Exemplary embodiments of the present invention relate to a device for printing, severing, and applying self-adhesive flat structures.

Such devices are known from the prior art.

Thus, a device for printing, severing, and applying self-adhesive flat structures, in particular labels, is described in DE 20 2013 103 136 U1. In this device, a carrier strip, on which an endless material strip is fastened using a pressure-sensitive adhesive, is drawn off from a supply roll and guided around a dispensing edge, at which a flat structure severed by the blade of a cutting mechanism from the material strip—for example, a label—is detached from the carrier strip and transferred to a stamp.

Labels cut to size individually to the respective task can be created by the endless material strip, so that in the event of changing label lengths, a change of the supply roll does not have to be performed, and/or supply rolls having labels of different sizes do not have to be acquired and kept ready.

To apply the flat structure severed from the material strip and held on the stamp by partial vacuum to an object to be identified, the stamp is automatically moved to this object by a handling device, the partial vacuum is canceled, and an overpressure is generated. The detachment of the label from the stamp is thus facilitated, so that the flat structure adheres with its adhesive layer on the object.

The device can have a printing device immediately before or after the cutting mechanism in the transportation direction of the carrier strip, in order to provide the flat structure with items of information.

This device has proven itself outstandingly in practice but has the disadvantage of only being able to process labels that adhere with the self-adhesive layer thereof on the carrier strip, from which the self-adhesive labels are drawn off before the application.

The carrier strip has no further use after the drawing off and application of labels, and generally has to be disposed of thermally as hazardous waste because of its chemical composition. Such a label material is thus costly to acquire and due to the obligation for proper disposal of the carrier strip.

Furthermore, a device for rolling up the carrier strip has to be provided on the labeling machine, so that the carrier strip, which is no longer required, does not interfere with the sequence of the labeling. The construction of the labeling machine is thus also made more expensive.

For this reason, label materials have been developed that dispense with a carrier strip and instead have a layer of heat-activatable adhesive on the side with which the label is to be applied to an object to be identified.

A heat-sealable label is thus described in EP 1 879 751 B1. It is accordingly provided that the label has a printable layer, a carrier layer, and a heat-sealable adhesive layer. The heat-sealable adhesive layer is a dry dispersion according to the technical teaching of EP 1 879 751 B1, which consists of polymer particles, in which at least 10% (W/W) of the total mass of polymer particles is formed by particles having an average particle diameter of at least approximately 0.5 μm, wherein the span, defined as (D90−D10)/D50, in which D10, D50, and D90 refer to the diameter of the 10% quantile, the 50% quantile, and the 90% quantile, respectively, of polymer particles, is at least 2 and the polymer particles have a coalescence temperature at or above 50° C.

A device that processes the label material according to EP 1 879 751 B1 has been presented in an article of the Danish daily newspaper "Bornholms Tidende" in the edition of 22 Sep. 2011 on page 15. The editions of this newspaper are archived in the Danish national library.

The device presented in the article has a belt applicator, by which a label unwound from a roll, printed with items of information, and discretized by a cutting device is applied to an object to be labeled which is guided past the device by a conveyor device. The label is conveyed by a belt of the belt applicator to the point that is to be provided with the label. The label is held in this case by partial vacuum on the moving belt—implemented here by a plurality of strands.

The device has a heating device, which is implemented by a heatable belt of a belt conveyor, downstream in the conveyor direction of the conveyor device, on which the object to be labeled is moved. The heat-sealable adhesive layer of the label is activated by the heatable belt, so that the applied label adhesively bonds with the surface of the object to be labeled. Alternatively, the heating device can also be arranged in the belt applicator. However, the operating principle according to which the heating device operates is not described.

This device has the disadvantage that a label is thus only applicable to one side of an object to be labeled—for example, a cuboid cardboard box—and only at one height thereon, specifically on the side that is reachable by the belt applicator and by the heating device. Furthermore, it is disadvantageous if multiple printed labels are already located beforehand on the belt conveyor and the device is therefore not suitable for real-time applications—for example, shipping address labeling or pallet labeling.

Exemplary embodiments of the invention accordingly are directed to a device for printing, severing, and applying self-adhesive flat structures, in particular labels, which overcomes the disadvantages of the prior art.

The present invention solves this problem in that the applicator is heatable by a heating device operating according to an electrical operating principle.

The heating of the applicator can thus be controlled simply and thus advantageously and the energy supply can be regulated. Furthermore, the device is real-time capable due to the heating ability of the applicator, because, due to the heating ability of the applicator, it avoids more than one label being located between printer and applicator per application procedure.

In one advantageous embodiment variant of the present invention, the heating device is formed by one or more heating wire/heating wires or heating spiral(s), which has or have a high ohmic resistance and preferably operates or operate using electrical AC voltage. The label material can thus advantageously be selected and processed without consideration of restrictions due to the type of heating. Furthermore, the material from which the respective stamp is manufactured can be freely selected without consideration of electrical properties. In addition, the label can advantageously also be combined with an RFID tag, without the RFID tag being destroyed or becoming unusable due to the type of heating.

In a further advantageous embodiment of the invention, the heating device operates with infrared radiation, plasma radiation, laser radiation, or electron beams. A heating device with low installation effort thus advantageously results.

It is furthermore advantageous for the heating device to be connected to a temperature regulator. The heat-sealable adhesive of the adhesive layer of the label is thus always melted at an optimum temperature for this purpose. Furthermore, the temperature regulator can advantageously be used for the purpose of saving energy during planned pauses.

It is also advantageous that the first plate-shaped stamp is movably mounted on the stamp-side end of the respective kinematic axis. Due to the flexible mounting, nonparallel orientations between the surface of the object to be labeled and the face of the stamp can advantageously be compensated for.

It has a particularly advantageous effect for the device to have a contact pressure device. It is advantageously ensured by the contact pressure device that the free end of the label bears over the entire area on the face of the stamp and the contact pressure device during the application procedure of the label.

In a further preferred embodiment variant of the invention, the contact pressure device has a second plate-shaped stamp, which is mounted so it is pivotable on the first plate-shaped stamp. It is easily and advantageously ensured by this advantageous embodiment of the contact pressure device that the free end of the label bears over the entire area on the face of the plate-shaped stamp and the contact pressure device during the application procedure of the label.

BRIEF DESCRIPTION OF THE DRAWING FIGURES

Figure 2:
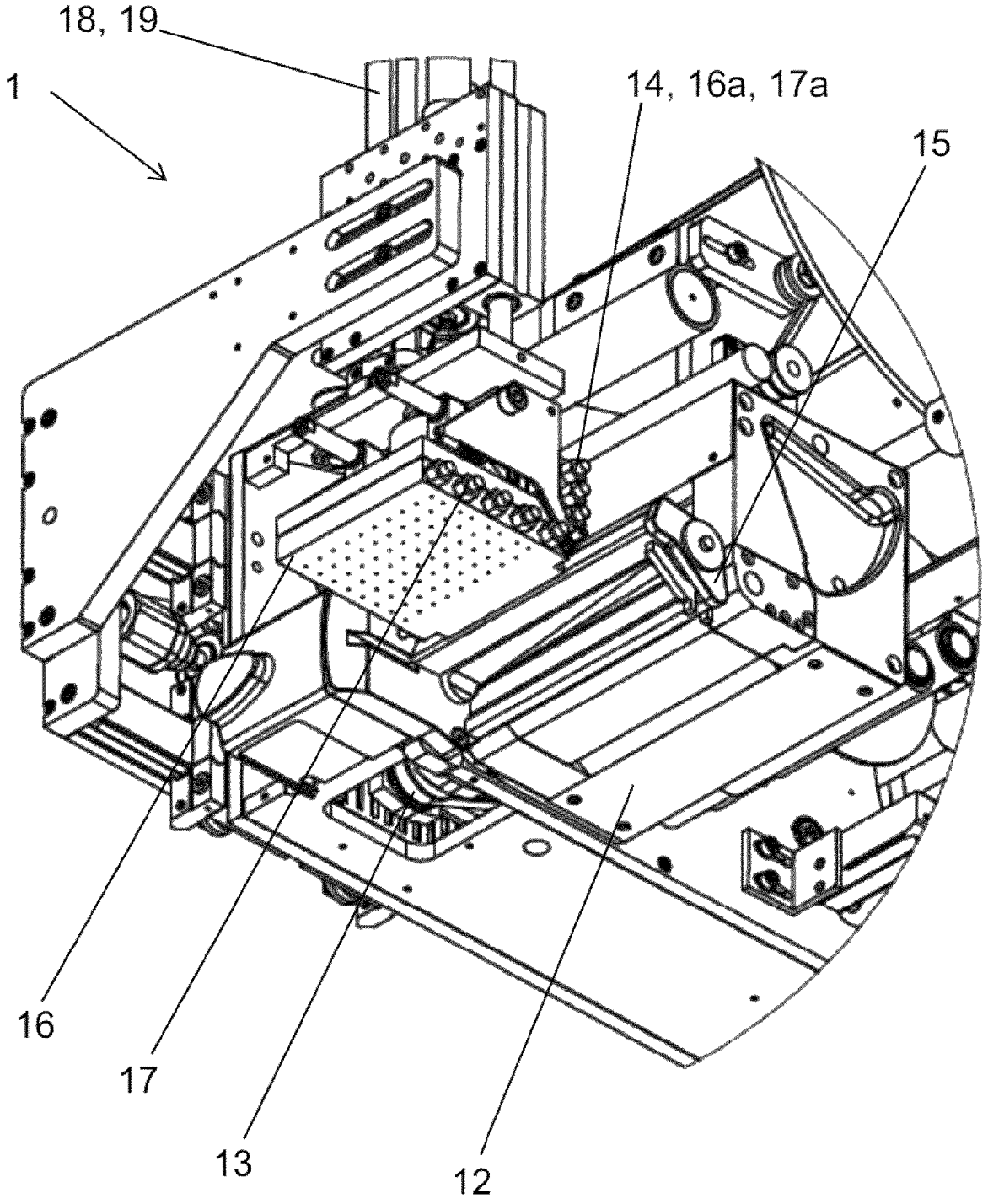
Figure 3:
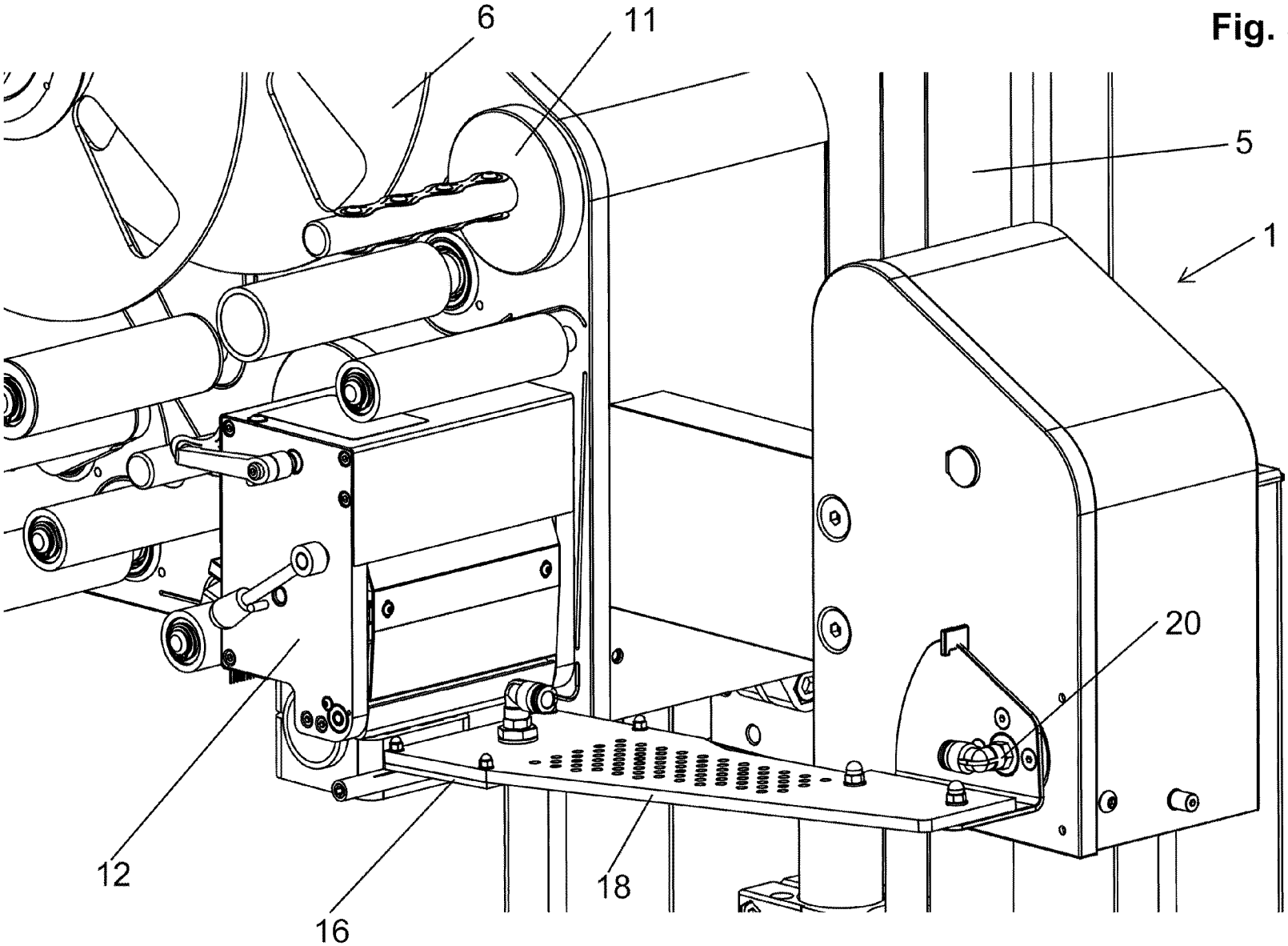
Figure 4:
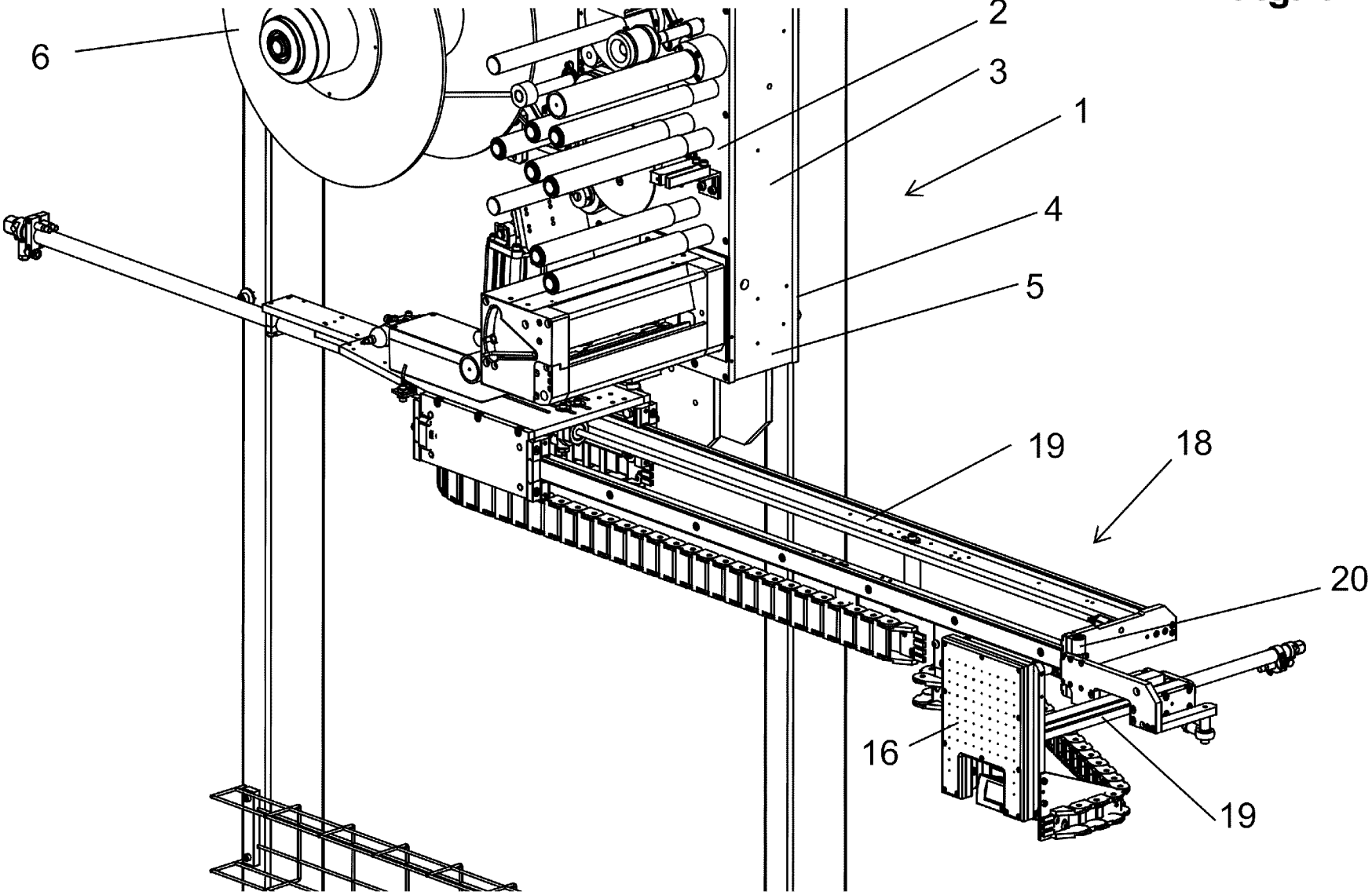
Figure 5:
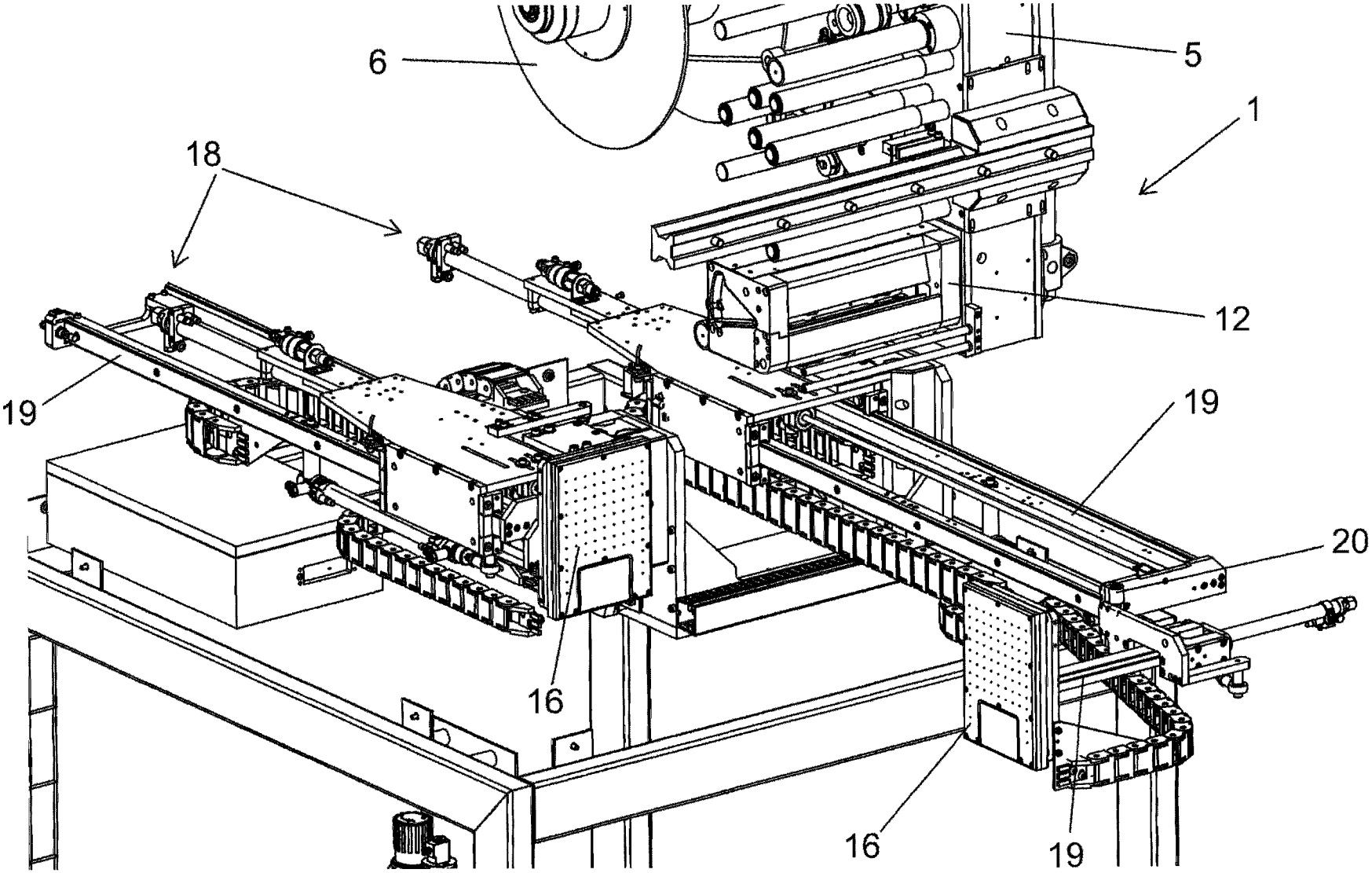
Figure 6:
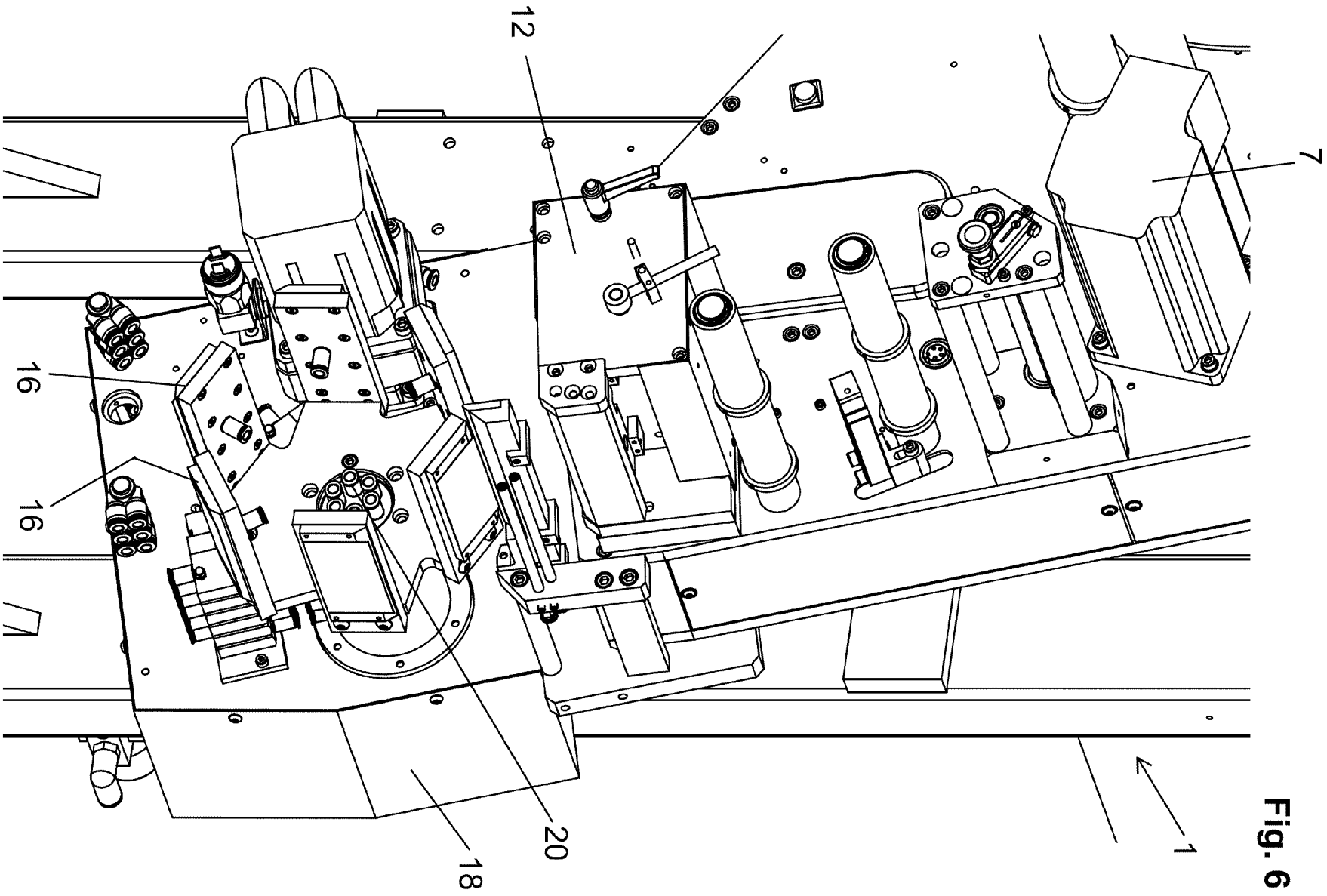
Figure 7:
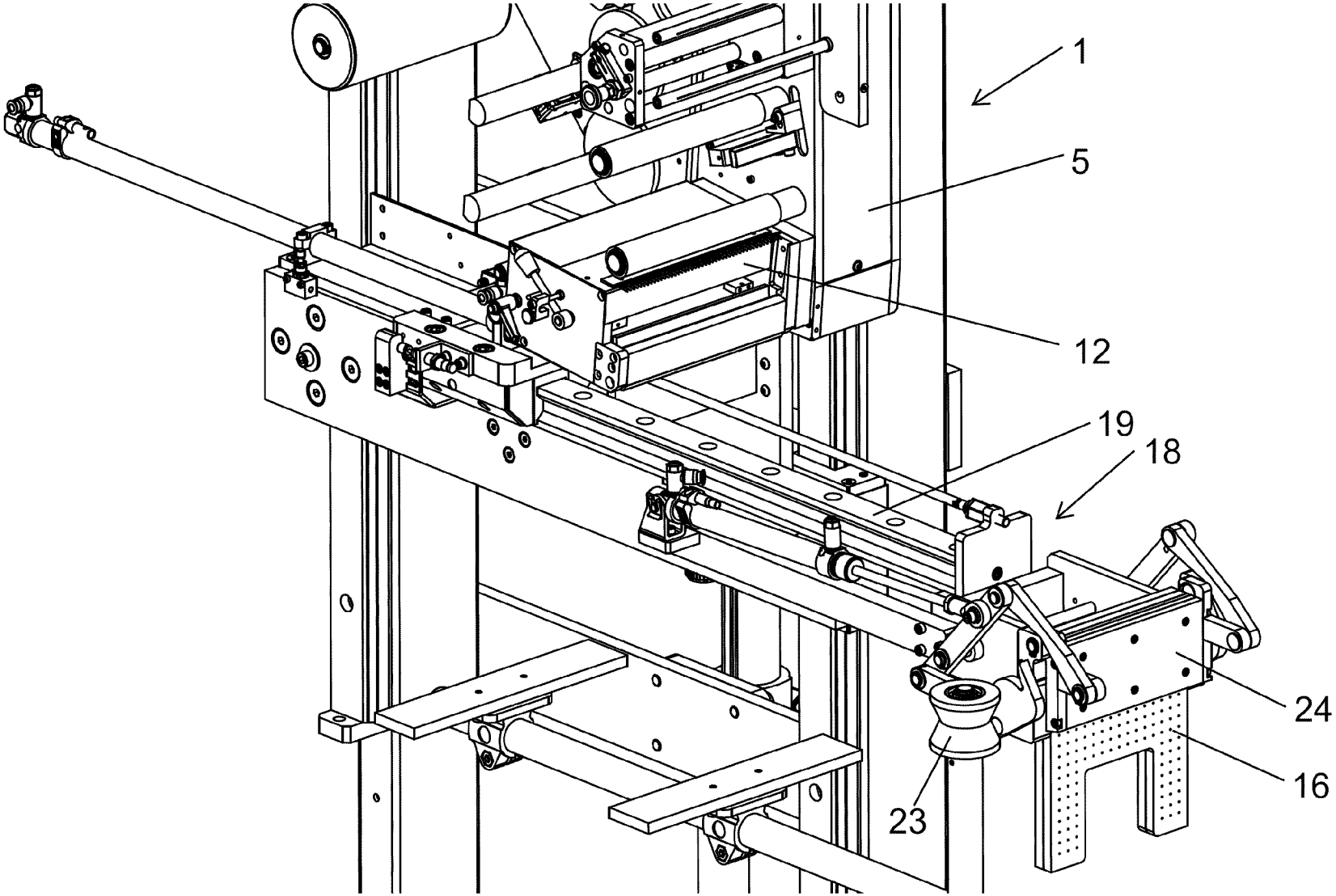
Figure 8:
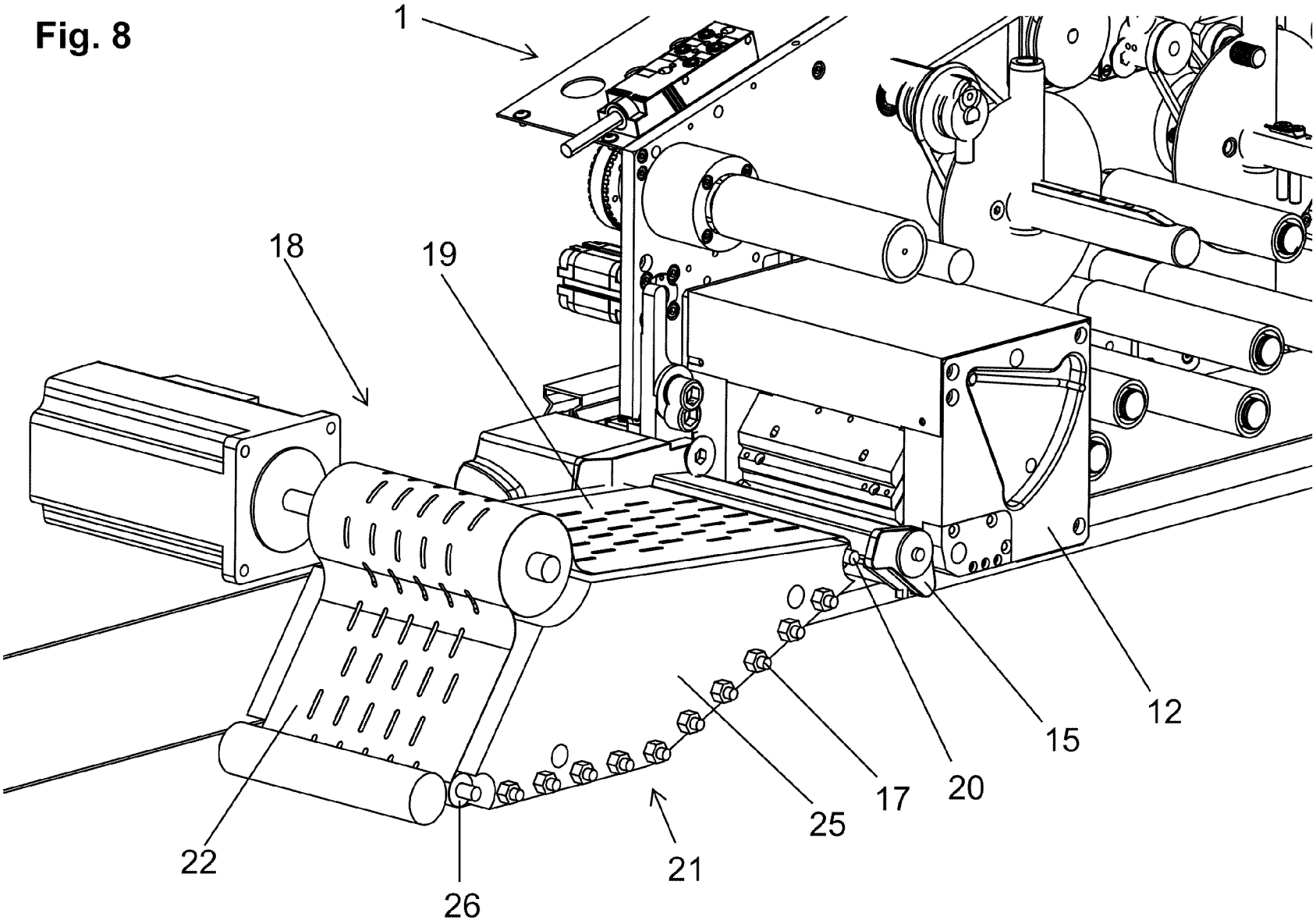

Exemplary embodiments of the subject matter according to the invention are illustrated in the drawings and will be described in greater detail hereafter. In the figures:

FIG. 1: shows a three-dimensional illustration of a device according to the invention;

FIG. 2: shows a detail enlargement of the device according to FIG. 1 having a handling device, which has a single translational kinematic axis;

FIG. 3: shows a detail enlargement of the device according to FIG. 1 having a handling device, which has a single rotational kinematic axis;

FIG. 4: shows a detail enlargement of the device according to FIG. 1 having a handling device, which has a first translational kinematic axis, a second rotational kinematic axis, and a third translational kinematic axis;

FIG. 5: shows a detail enlargement of the device according to FIG. 1 having a handling device which has two handling modules;

FIG. 6: shows a detail enlargement of the device according to FIG. 1 having a handling device which has a single rotational kinematic axis, wherein the handling device has a stamp which is provided multiple times like a revolver;

FIG. 7: shows a detail enlargement of the device according to FIG. 1 having a handling device, which has a first rotational kinematic axis, a second translational kinematic axis, and a wrapping device;

FIG. 8: shows a detail enlargement of the device according to FIG. 1 having a handling device, which has a first rotational kinematic axis and a second translational kinematic axis, wherein the second translational kinematic axis is designed as a belt conveyor.

Figure 9:
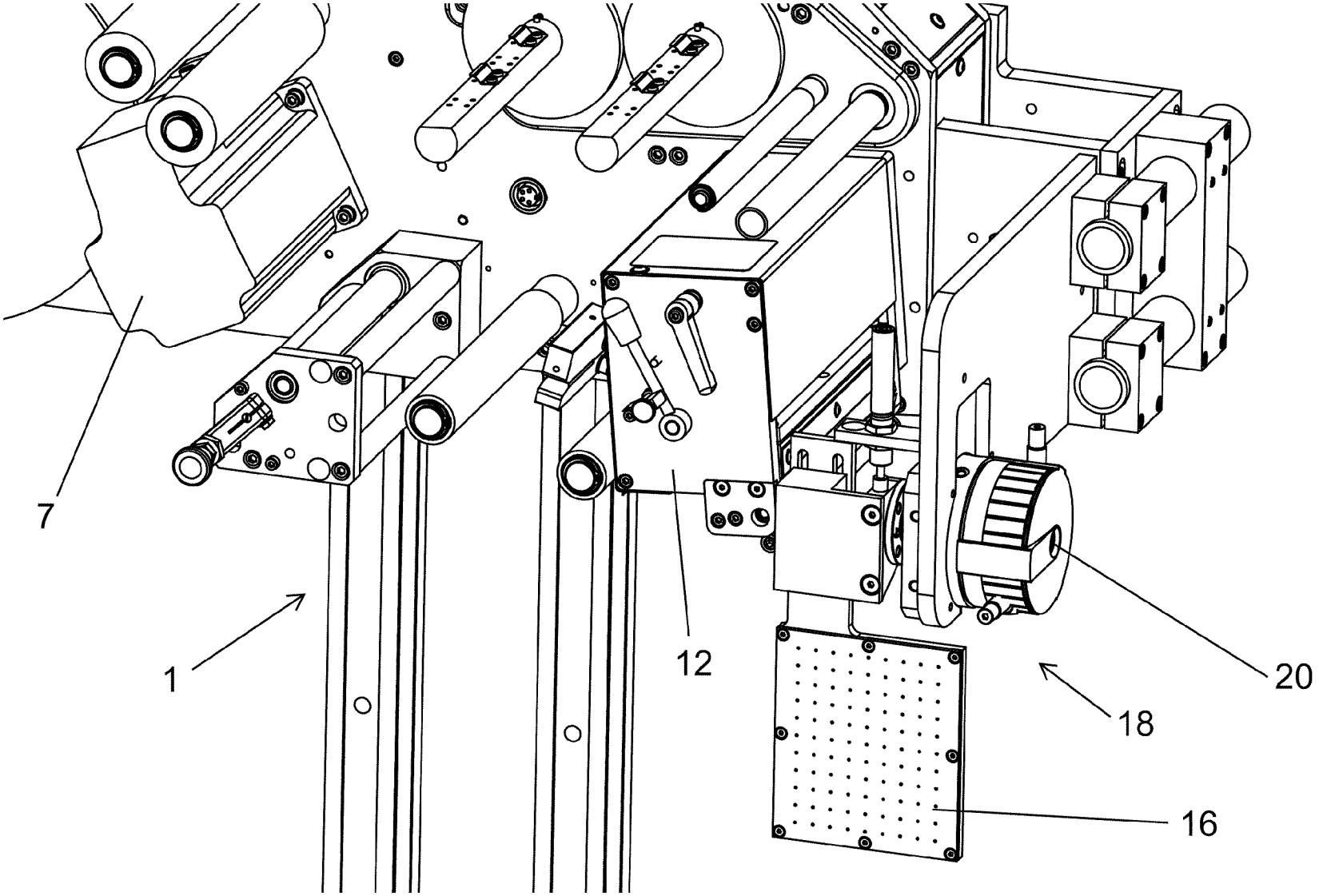

FIG. 9: shows a detail enlargement of the device according to FIG. 1 having a handling device which as a rotational kinematic axis.

DETAILED DESCRIPTION

FIG. 1 shows a device 1 for printing, severing, and applying self-adhesive flat structures, in particular labels. The device 1 has a machine stand (not shown here), which supports the actual device 1. The device 1 furthermore has a base plate 2, on which the essential assemblies of the device 1 are fastened and/or mounted. The base plate 2 forms a housing-type main body 5 with multiple spacers 3 and a cover 4.

The device 1 can optionally also be configured for the purpose of processing a conventional label material having a carrier strip. In this case, the device 1 also has an unrolling device 6 for a material strip (not shown), which is indirectly driven by a motor having distance measuring system—embodied here by way of example as a stepping motor 7. In this context, indirectly means that the stepping motor 7 drives a carrier strip drive for the carrier strip (not shown). Furthermore, the device 1 then has a winding device (not shown) for the carrier strip.

The movement momentum on the unrolling device 6 is then transferred by the material strip and/or the carrier strip, which is used in this context as the traction means. The stepping motor 7 is activated by a central control unit (not shown).

The material strip (not shown) located in the form of a storage roll (not shown) on the unrolling device 6 thus has the carrier strip (not shown) in this case, on which a self-adhesive useful strip (not shown) is applied.

The device 1 illustrated in FIG. 1 operates with a label material without a carrier strip.

In the case of label material without a carrier strip, conventional adhesive is typically used, which is microencapsulated, for example. This has the disadvantage that an increased cleaning effort is required in each case for the printing device and/or the severing device. In addition, the function of the severing device is strongly impaired by adhesive residues.

The device illustrated in FIG. 1 therefore preferably operates with a label material such as that described in EP 1 879 751 B1.

The material strip located in the form of a storage roll (not shown) of the label material (not shown) without a carrier strip has a printable layer, a carrier layer, and the heat-sealable adhesive layer. It is to be expressly noted once again at this point that the material strip of the label material without a carrier strip does not have a carrier strip.

The material strip of the label material without a carrier strip can be produced from any arbitrary and/or suitable material, for example, paper, film, foam, single-material laminates, or laminates which are formed from a combination of the above-mentioned materials.

It is also possible that the material strip of the label material without a carrier strip is produced from multiple plies of self-adhesive layers made of the above-mentioned materials or combinations thereof. It is also possible that the material strip has RFID transponders with or without sensors. In particular temperature and/or moisture sensors are provided as sensors.

The device 1 furthermore has multiple tensioning rollers 8, which guide and keep tensioned the material strip. The device 1 additionally has multiple deflection rollers 9, which deflect the material strip in order to supply it in a defined position to devices which are attached to the main body 5.

The device 1 furthermore has a printing unit 12, which prints the printable layer of the material strip with the desired items of information for a load carrier and/or goods on a load carrier in clear text and/or encrypted or coded via a barcode. The printing unit 12 also receives its control commands from the central control unit.

The printing unit 12 has a driven intake roller 13 (see FIG. 2), which draws the material strip of the label material without a carrier strip into the printing unit 12. The intake roller 13 is driven by a motor having distance measuring system—embodied here as a stepping motor by way of example. The stepping motor also receives its control commands from the central control unit.

The printing unit 12 preferably operates in the thermal printing method, for example, in the thermal transfer or thermal direct printing method, alternatively, the printing unit 12 can also operate in the inkjet or laser printing method.

If the printing unit 12 operates in the thermal transfer printing method, the main body 5 has an unwinding device 10 for one or more thermal transfer printing ink ribbons and a winding device 11 for one thermal transfer printing ink ribbon or multiple thermal transfer printing ink ribbons. The winding device 11 receives the used ink ribbon or the used ink ribbons, so that they can be removed and disposed of easily.

After the printable layer of the material strip has been printed with the desired items of information on a defined load carrier and/or goods on a load carrier in clear text and/or encrypted or coded via a barcode, for example, by the printing unit 12, the material strip of the label material without a carrier strip is guided with properly printed printable layer of the material strip 8 of the label material without a carrier strip into a severing device 15. The severing device 15 completely severs the material strip of the label material without a carrier strip, so that a discrete flat structure or label having defined size is created, which bears or includes the desired items of information on the defined load carrier and/or goods on a load carrier. The severing device 15 is controlled by the central control unit.

Before the printing procedure of the next label, it is possible to move the material strip 8 in reverse, i.e., in the direction of the unrolling device 6. This advantageously enables printing of a part of the material strip 8 which is located in the severing device 15 during the severing procedure of the preceding flat structure or label.

Since in the case of the label material without a carrier strip the severed material strip or the label cannot be pushed further via the carrier strip (not shown here), but the severing device 15 requires free space, i.e., a distance in relation to a first plate-shaped stamp 16 to be able to operate properly, so that a free end of the label results, the device 1 has a contact pressure device 14.

The contact pressure device 14 has a second plate-shaped stamp 16*a*, which is mounted so it is pivotable on the first plate-shaped stamp 16. It is advantageously ensured by the contact pressure device 14 that the free end of the label bears over the entire area on the face of the plate-shaped stamp 16 and the contact pressure device 14 during the application procedure of the label.

For this purpose, the pivotable, second plate-shaped stamp 16*a* is moved by the contact pressure device 14 out of a base position into an application position, so that a face of the pivotable second plate-shaped stamp 16*a* of the contact pressure device 14 lies area-congruent with the face of the non-pivotable first plate-shaped stamp 16 and thus the free end of the label is supported during the application procedure.

The applicator 16, 16*a* is thus formed here by the first plate-shaped stamp 16 and the second plate-shaped stamp 16*a*.

The term "plate-shaped" means that the stamps 16, 16*a* are each a limited flat piece of a rigid material—metal here, of equal thickness overall, on two opposing sides limited in relation to the thickness of the very extended planar face.

The term "plate-shaped" is also understood in the meaning of the present invention as a concave or convex deviation of the planarity by at most the absolute value of the measurable remaining thickness of the plate. It accordingly results that the total thickness of the plate minus the maximum deviation of the planarity of the plate results in the measurable remaining thickness that has to correspond at least to the maximum absolute value of the deviation from the planarity.

The flat structure or the label is held by partial vacuum in each case on the face of the first plate-shaped stamp 16 and the second plate-shaped stamp 16*a*.

The first plate-shaped stamp 16 and the second plate-shaped stamp 16*a* each have a heating device 17, 17*a*, respectively, which operates according to an electrical operating principle.

The heating device 17, 17*a* is formed here by way of example in each case by one or multiple heating wire/heating wires or heating spiral(s) (not shown here), which has or have a high electrical resistance and preferably operates or operate with electrical AC voltage.

The label material can thus advantageously be selected and processed without consideration of restrictions due to the type of heating. Furthermore, the material from which the first stamp 16 and the second stamp 16*a* are each manufactured can be freely selected without consideration of electrical properties. In addition, the label can advantageously be combined with an RFID tag—with or without sensors—without the RFID tag being destroyed or becoming unusable due to the type of heating.

The heating device 17, 17*a* is integrated in each case in the first stamp 16 or in the second stamp 16*a*, respectively, so that the heating action of the heating device 17, 17*a* is transferred by heat conduction and/or thermal radiation to the first stamp 16 or to the second stamp 16*a*, respectively, and thus to the activatable adhesive layer of the heat-sealable label.

Alternatively, the heating device 17, 17*a* can also be implemented according to the operating principle of electromagnetic radiation, so that the heating effect is generated by infrared radiation, plasma radiation, laser radiation, or electron beams.

In another alternative embodiment of the heating device 17, 17*a*, the heating effect is generated according to the operating principle of electromagnetic fields, which generate capacitive heating, so that the heating effect is generated by microwaves or high-frequency fields.

In a further alternative embodiment of the heating device 17, 17*a*, the heat transfer to the first stamp 16 or to the second stamp 16*a*, respectively, is performed by a fluidic heat carrier, for example, hot air.

The heating device 17, 17*a* is connected in each case to a temperature regulator, by which the temperature of the first stamp 16 or the second stamp 16*a*, respectively, is advantageously kept constant at a defined temperature value, so that the heat-sealable adhesive of the adhesive layer of the label is always melted using an optimum temperature for this purpose.

The first plate-shaped stamp 16, on which the flat structure or the label is held here by partial vacuum, is moved from a base position to an object to be identified or to a load unit of goods or products combined using a load carrier by a handling device 18, which is constructed according to the principle of an open kinematic chain—embodied solely by way of example in FIG. 1 with a single translational kinematic axis 19 having a fluidic drive.

The term "open kinematic chain" describes a mechanical system of bodies connected to one another that are capable of transferring a force to one another and thus generating a movement. A kinematic chain is open if a part of the chain can be excluded from the respective force transfer process and can be moved independently thereof with respect to other links of the chain, i.e., freely. In other words, each link of an open kinematic chain has at most two joints, via which it can execute a movement, while a closed kinematic chain has precisely two joints per link.

The term "kinematic axis" is to be understood as synonymous to the defined rotational and/or translational degrees of movement freedom of the joints of the link/the links of an open kinematic chain—i.e., the handling device 18.

In this case, the second pivotable stamp 16*a* is moved into an application position by the contact pressure device 14, so that the flat structure or the label is supported over the entire area and thus touches the object to be identified over the entire area and adheres with its activated adhesive layer on the object to be identified.

To be able to hold the flat structure or the label by partial vacuum on the first plate-shaped stamp 16 and/or on the second pivotable stamp 16*a* of the contact pressure device 14, the first plate-shaped stamp 16 and the second plate-shaped stamp 16*a* each have a plurality of boreholes.

After the flat structure or the label adheres on the object to be identified, the partial vacuum is switched off and an overpressure is generated. The detachment of the label from the stamp 16 is thus facilitated and the flat structure or the label is thus applied to the object to be identified by the plate-shaped stamp 16 and the pivotable part of the stamp 16, which is associated with the contact pressure device 14.

During the application procedure, the second pivotable stamp 16*a* forms a planar face with the first stamp 16. After completed application of the flat structure or label, the handling device 18 is moved back into the base position.

The handling device 18 can also be embodied with one or more rotational kinematic axis (axes) 20 or a combination of one or more translational kinematic axis (axes) 24 and one or more rotational kinematic axis (axes) 20.

The first plate-shaped stamp 16 is movably mounted on the stamp-side end of the respective kinematic axis 19, 20. The movable mounting is implemented, for example, by one or more rubber-metal element(s) or ball joint(s). Due to the flexible mounting, nonparallel orientations between the surface of the object to be labeled and the face of the stamp 16 can advantageously be compensated for.

One or more translational kinematic axes 19 of the handling device 18 can also be embodied as a belt conveyor 21 having in each case one or more conveyor belts 22.

The kinematic axis (axes) 19, 20, in particular the rotational kinematic axis (axes) of the handling device 18 thus do not rotate at a substantially uniform velocity in operation, but rather execute a cyclic movement, in which in particular the rotational kinematic axis (axes) 20, but also the translational kinematic axis (axes) 19 execute rotational or pivot movements from a defined base position or idle position by a defined angle amount or linear movements by a defined length amount.

The drive of the kinematic axes 19, 20 of the handling device 18 can alternatively also be performed by electric motors. In addition, a combination of kinematic axes 19, 20 driven by fluid and driven by electric motors is also possible. The handling device 18 is controlled by the central control unit.

The handling device 18 from FIG. 1 is illustrated enlarged in FIG. 2. The intake roller 13 of the printing unit 12 is also shown so it is well recognizable in FIG. 2.

FIG. 3 shows a further embodiment variant of the handling device 18. The handling device according to FIG. 2 has a single rotational kinematic axis 20. The conveyor direction of the material strip is parallel to the conveyor direction of the object to be labeled here.

The handling device 18 in the embodiment variant according to FIG. 3 therefore enables labeling of an end face and/or rear side of prismatic or cuboid objects in the pass-through method simply and thus advantageously. This means that an object to be identified, which is moved on a conveyor device, advantageously does not have to be braked or come to a standstill for the labeling procedure.

FIG. 4 shows a further embodiment variant of the handling device 18. The handling device 18 according to FIG. 4 has a first translational kinematic axis 19, a second rotational kinematic axis 20, and also a third translational kinematic axis 19 here.

The handling device 18 in the embodiment variant according to FIG. 4 enables labeling of two or more different sides of prismatic or cuboid objects simply and thus advantageously. This can advantageously also be performed in two different vertical positions by an optional further translational kinematic axis (not shown here), which operates in the vertical direction.

FIG. 5 shows a further embodiment variant of the handling device 18. The handling device 18 according to FIG. 5 has two handling modules here. The first handling module has a first translational kinematic axis 19, a second rotational kinematic axis 20, and a third translational kinematic axis 19. The second handling module has a single translational kinematic axis 19 here. Alternatively, the second handling module can also have further kinematic axes 19, 20.

The handling device 18 in the embodiment variant according to FIG. 5 enables labeling of two sides of prismatic or cuboid objects simply and thus advantageously. This can advantageously be performed simultaneously on two different sides of the object to be identified by the two handling modules of the handling device 18 according to FIG. 5.

FIG. 6 shows a further embodiment variant of the handling device 18. The handling device 18 according to FIG. 6 has a single rotational kinematic axis 20. The first plate-shaped stamp 16 is provided multiple times like a revolver—six times here, for example—so that the label is received in one defined position of the respective stamp 16 and applied to the object to be identified by blowing off from the respective stamp 16 in another defined position of the stamp 16.

The handling device 18 in the embodiment variant according to FIG. 6 enables particularly rapid labeling of one side of prismatic or cuboid objects simply and thus advantageously.

FIG. 7 shows a further embodiment variant of the handling device 18. The handling device 18 according to FIG. 7 has a first rotational kinematic axis 20 (not shown here) and a second translational kinematic axis 19. The handling device 18 furthermore has a wrapping device, of which a deflection roller 23 is shown here, using which, for example, a securing cord can be wrapped around a formation of reusable beverage crates, which are located on a load carrier—for example, a pallet. Furthermore, the handling device 18 has a folding device 24, using which the label can be folded around the securing cord.

FIG. 8 shows a further embodiment variant of the handling device 18. The handling device 18 according to FIG. 8 is designed as a belt applicator and has a first rotational kinematic axis 20 and a second translational kinematic axis 19. The second translational kinematic axis 19 is designed as a belt conveyor 21.

The conveyor belt 22 carries the label, which is held by partial vacuum on the opening 22 through openings in the conveyor belt 22. Alternatively, the conveyor belt 22 can also be formed by a plurality of strands arranged parallel and spaced apart, so that the partial vacuum acts on the label through the spacing between two strands.

The heating device 17 is housed here in a strip box 25 of the belt conveyor 21 and operates according to an electrical operating principle. The heating device 17 is formed here by way of example in each case by one or multiple heating wire/heating wires or heating spiral(s) (not shown here), which has or have a high electrical resistance and preferably operates or operate with electrical AC voltage.

"High ohmic resistance" means in the meaning of the present invention an ohmic resistance such that it generates a heating effect upon application of a voltage.

The label material can thus advantageously be selected and processed without consideration of restrictions due to the type of heating. Furthermore, the material from which the strip box 25 is manufactured can be selected freely without consideration of electrical properties. In addition, the label can advantageously also be combined with an RFID tag, without the RFID tag being destroyed or becoming unusable due to the type of heating.

The heating effect of the heating device 17 acts here by way of heat conduction and/or thermal radiation on the conveyor belt 22 and is thus transferred to the activatable adhesive layer of the heat-sealable label.

Alternatively, the heating device 17 can also be implemented according to the operating principle of electromagnetic radiation, so that the heating effect can be generated by infrared radiation, plasma radiation, laser radiation, or electron beams.

In another alternative embodiment, the heating device 17 is embodied according to the operating principle of electromagnetic fields, which generate capacitive heating, so that the heating effect is then generated by microwaves or high-frequency fields.

In a further alternative embodiment of the heating device 17, the heat transfer occurs indirectly or directly to the conveyor belt 22 by a fluidic heat carrier, for example, hot air.

The heating device 17 is connected to a temperature regulator, by which the temperature of the conveyor belt 22 is advantageously kept constant at a defined temperature value, so that the heat-sealable adhesive of the adhesive layer of the label is always melted using a temperature optimum for this purpose. Furthermore, the temperature regulator can advantageously be used for the purpose of saving energy during planned pauses.

The label is applied to the object to be identified at the point of the belt conveyor 21 at which the conveyor belt 22 runs over a deflection roller 26 spaced apart from an articulation point of the rotational kinematic axis and touches the object tangentially in the region of this deflection roller 26 or is held quasi-tangentially at a slight distance from the object. In this case, a plate-shaped stamp 16 is thus not provided, which acts as an applicator, but rather a quasi-cylindrical applicator is provided, which is formed by the interaction of the deflection roller 26 and the conveyor belt 22.

FIG. 9 shows a further embodiment variant of the handling device 18. The handling device 18 according to FIG. 2 has a single rotational kinematic axis 20. The conveyor direction of the material strip is orthogonal to the conveyor direction of the object to be labeled here.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 device
2 base plate
3 spacer
4 cover
5 main body
6 unrolling device
7 stepping motor
8 tensioning roller
9 deflection roller
10 unwinding device for ink ribbon
11 winding device for ink ribbon
12 printing unit
13 intake roller
14 contact pressure device
15 severing device
16, 16*a* stamp
17, 17*a* heating device
18 handling device
19 translational kinematic axis
20 rotational kinematic axis
21 belt conveyor
22 conveyor belt
23 deflection roller
24 folding device
25 strip box
26 deflection roller

The invention claimed is:

1. A device for printing, severing, and applying self-adhesive labels, the device comprising:

an applicator, by which a self-adhesive label is applied onto an object to be identified, wherein the self-adhesive label comprises a label material without a carrier strip, which has a printable layer, a carrier layer, and a heat-sealable adhesive layer, wherein the applicator comprises a first plate-shaped stamp and a second plate-shaped stamp;

a handling device configured to move the applicator to the object to be identified, wherein the handling device is configured according to the principle of an open kinematic chain and has at least one translational kinematic axis and/or at least one rotational kinematic axis;

a contact pressure device; and a heating device configured to heat the applicator, wherein the heating device operates according to an electrical operating principle.

2. The device of claim 1, wherein the heating device comprises at least one heating wire or heating spiral having a high electrical resistance and operating with electrical AC voltage.

3. The device of claim 1, wherein the heating device operates with infrared radiation, plasma radiation, laser radiation, or electron beams.

4. The device of claim 1, further comprising:

a temperature regulator coupled to the heating device.

5. The device of claim 1, further comprising:

a printing unit.

6. The device of claim 1, further comprising:

an electric motor configured to drive the at least one translational kinematic axis of the handling device.

7. The device of claim 1, wherein the at least one translational kinematic axis of the handling device is fluidically driven.

8. The device of claim 1, wherein the first plate-shaped stamp is mounted so it is movable on a stamp-side end of the at least one translational kinematic axis.

9. The device of claim 8, wherein the contact pressure device has the second plate-shaped stamp, which is mounted so it is pivotable on the first plate-shaped stamp.

10. The device of claim 9, wherein the pivotable second plate-shaped stamp is moveable by the contact pressure device from a base position into an application position, so that a face of the pivotable second plate-shaped stamp of the contact pressure device lies area congruent to a face of the non-pivotable first plate-shaped stamp.

11. The device of claim 10, wherein the first plate-shaped stamp and the second plate-shaped stamp each have a plurality of boreholes, through which the self-adhesive label is held by partial vacuum or can be blown off by overpressure, respectively, on the face of the first plate-shaped stamp and on the face of the second plate-shaped stamp.

* * * * *